United States Patent [19]

Sheftel

[11] 4,036,462

[45] July 19, 1977

[54] MUSICAL INSTRUMENT SUPPORTING APPARATUS

[76] Inventor: Edward A. Sheftel, 1456 Colby, Apt. 4, Los Angeles, Calif. 90053

[21] Appl. No.: 265,157

[22] Filed: June 22, 1972

[51] Int. Cl.[2] ..... G10G 5/00

[52] U.S. Cl. ..... 248/166; 211/13; 211/203; 248/168; 248/188.6; 248/188.7

[58] Field of Search ..... 211/13, 178, 179, 188, 211/188.6, 177; 248/121, 127, 165, 166, 168, 170, 439, 188.7; 306/13; 287/14

[56] References Cited

U.S. PATENT DOCUMENTS

| | | | |
|---|---|---|---|
| 1,000,618 | 8/1911 | Meyer | 248/188 |
| 1,959,886 | 5/1934 | Wadsworth | 248/168 X |
| 2,464,031 | 3/1949 | Fiedel | 211/13 X |
| 2,775,424 | 12/1956 | Harris | 287/14 X |
| 3,178,143 | 3/1965 | Gustin | 248/168 |
| 3,221,891 | 12/1965 | Snow | 211/13 |
| 3,357,666 | 12/1967 | Smith | 248/168 X |
| 3,523,670 | 8/1970 | Pfister et al. | 248/168 |
| 3,591,116 | 11/1969 | Dalum | 248/166 |

FOREIGN PATENT DOCUMENTS

| | | | |
|---|---|---|---|
| 694,378 | 9/1930 | France | 248/121 |
| 1,406,689 | 6/1965 | France | 287/14 |

*Primary Examiner*—Roy D. Frazier
*Attorney, Agent, or Firm*—Michael A. Painter

[57] ABSTRACT

A supporting apparatus for musical instruments. A pair of complementary collapsible members are joined by a variable length member, the structure adapted for supporting one or more musical instruments. Each collapsible member comprises a central hub having a pair of pivotally coupled legs and a coupling member adapted to receive the variable length spreader support. All portions of the assembled apparatus contain receiving elements for supporting mounted musical instruments.

1 Claim, 6 Drawing Figures

Fig. 1
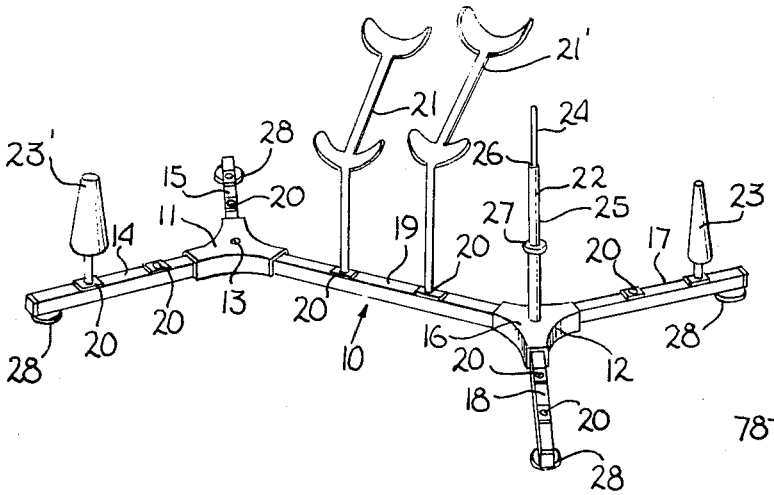
Fig. 6
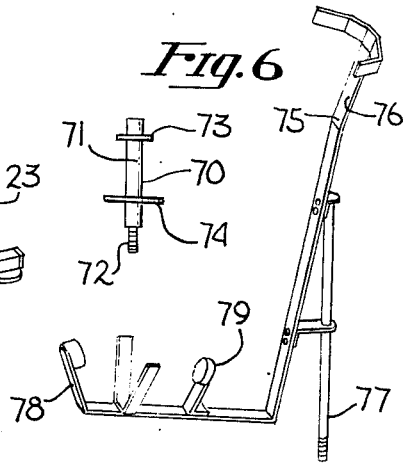
Fig. 2
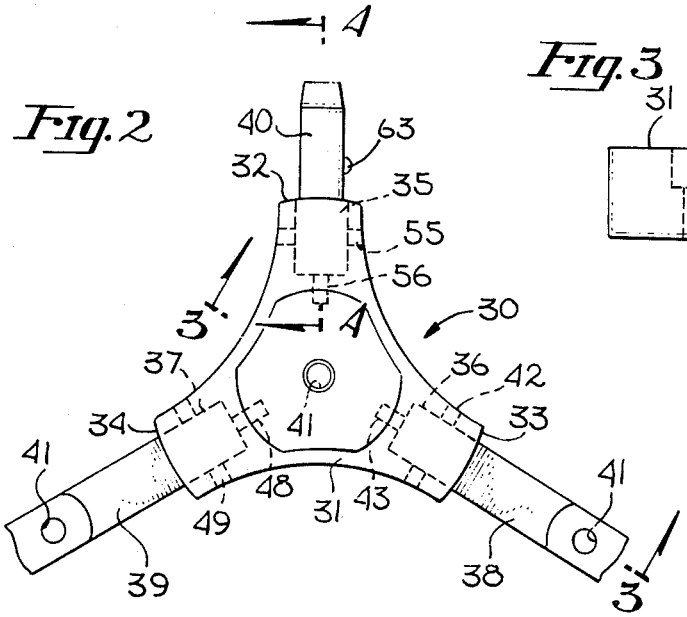
Fig. 3
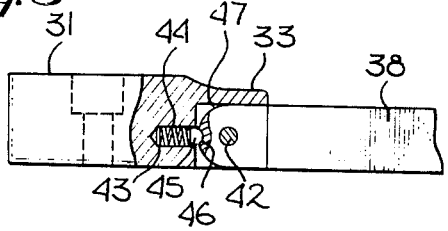
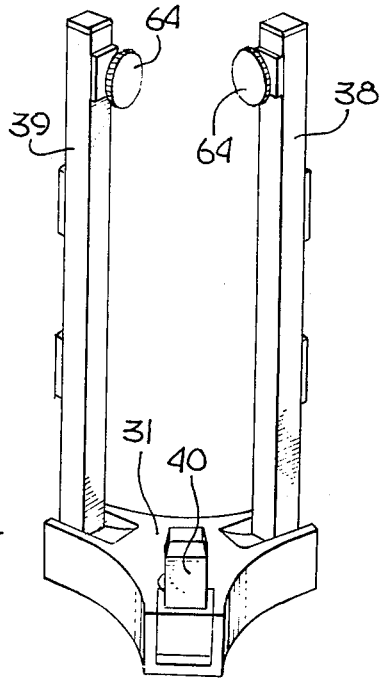
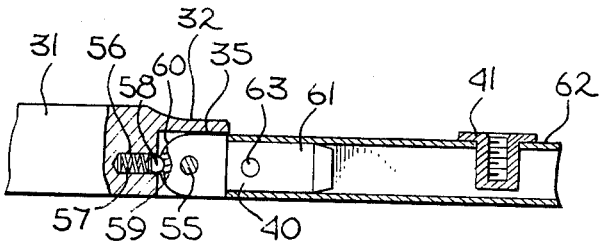
Fig. 4
Fig. 5

MUSICAL INSTRUMENT SUPPORTING APPARATUS

BACKGROUND OF THE INVENTION

1. Field of the Invention

The present invention generally relates to musical instrument stands and, more particularly, to collapsible musical stands adapted for supporting a plurality of musical instruments.

2. Prior Art

Many devices are disclosed by the prior art for supporting musical instruments during a musical performance or at other pertinent times. The devices disclosed by the prior art seek to attack problems with regard to portability, compactness, sturdiness and ability to support more than a single musical instrument. Typical devices disclosed by the prior art provide a supporting frame with upwardly depending extensions for supporting musical instruments. A typical device disclosed by the prior art utilizes a base made by securing two base plates in a perpendicular relationship with respect to one another. To attack the problem of portability, one of the base plates is foldable upon itself and utilizes a securing member such as a wing nut or other such devices. The extensions used for supporting the musical instruments depend upwardly from one of the base plates and are mounted thereupon by bolts and nuts or other such conventional couplings. One of the most critical characteristics of any supporting structure for musical instruments is its ability to resist tipping over or otherwise causing the instruments to come in contact with each other or with the surface upon which the supporting apparatus rests. The device disclosed by the prior art fails to provide a sturdy base for the musical instruments since merely a single pair of base plates will not provide the structural stability which is needed.

Another device disclosed by the prior art for mounting musical instruments utilizes a web having three arm extensions depending outwardly therefrom to provide a base for an extension to support the musical instruments. Even when this device is collapsible upon itself, there is the inability to support heavy instruments or to provide the type of structure which is necessary to meet the characteristics described hereinabove.

The present invention substantially solves the problems left unresolved by the devices disclosed in the prior art. The present invention utilizes a pair of complementary base members coupled together by means of a variable length receiving support. Each base member comprises a central hub having three extensions therefrom, two of the extensions being pivotally mounted legs, the third extension adapted to receive the variable length spreader support. When the two members are coupled together by means of the variable length spreader support, the present invention provides a collapsible supporting apparatus for musical instruments which substantially meets all of the criteria set forth hereinabove in a manner not disclosed by the prior art.

SUMMARY OF THE INVENTION

The present invention comprises a supporting apparatus for a plurality of musical instruments which combines characteristics of collapsibility, structural sturdiness and flexibility. The present invention utilizes a pair of complementary base members which combine to provide the support necessary to achieve the objects of the present invention. Each base member comprises a central hub having three uniformly distributed extensions therefrom. Two pivotally coupled legs depend from each central hub, each of the extended legs being placed in a locked position when in a planar relationship with the central hub. The third extension from each central hub comprises a pivotally coupled extension member adapted to receive the variable length spreader support disposed between the two supporting bases. The extension member depends from the central hub in a manner which is opposite the leg extensions and which bisects the angle therebetween.

The supporting bases are coupled by a variable length supporting member which is slidably coupled to each of the extension members on each central hub. The selection of the appropriate length for the variable length spreader support depends only on the number of instruments sought to be supported. Each of the extended legs, central hub and variable length spreader support contain means for supporting musical instruments. The type of instruments which can be mounted upon the present invention are typically represented by such instruments as saxophones, trumpets, trombones, flutes, claranets, and double reeds or other instruments which can be supported by the bell or body portion of the instrument.

It is therefore an object of the present invention to provide an improved supporting apparatus for musical instruments.

It is another object of the present invention to provide a collapsible supporting apparatus for musical instruments which provides a sturdy structure when in the open position.

It is still another object of the present invention to provide an improved supporting apparatus for musical instruments which can be supported by the bell portion of the instrument.

It is yet another object of the present invention to provide a supporting apparatus having interchangeable members to support musical instruments.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWING

FIG. 1 is a perspective view of a musical instrument supporting apparatus in accordance with the present invention.

FIG. 2 is a top plan view of a base member as illustrated in FIG. 1.

FIG. 3 is a side elevation, cross-sectional view of the hub-leg coupling taken through line 3—3 of FIG. 2.

FIG. 4 is a side elevation, cross-sectional view of the hub-extension coupling taken through line 4—4 of FIG. 2 including a cross-sectional view of a mounted spreader bar assembly.

FIG. 5 is a perspective view of a single base member shown in the collapsed position.

FIG. 6 illustrates additional instrument supports for the form of the present invention shown in FIG. 1.

Description of the Presently Preferred Embodiment

An understanding of the present invention can be best gained by reference to FIG. 1 wherein a perspective view of the present invention musical instrument supporting apparatus is shown, the apparatus being generally designated by the reference numeral 10. The present invention musical instrument supporting apparatus 10 is comprised of a pair of base members 11 and 12 which are identical with one another. Base member 11 is comprised of central hub 13 which has pivotally coupled thereto legs 14 and 15. Also pivotally coupled to hub 13 is an extension member which is not shown. Legs 14 and 15 and the extension member are preferably disposed about central hub 13 in a uniform manner to provide for the greatest degree of stability. In the embodiment of the present invention shown in FIG. 1, the extension member will be depending from hub 13 opposite from legs 14 and 15 and bisecting the angle between legs 14 and 15.

In a like manner, base member 12 is comprised of central hub 16 which has uniformly disposed thereabout pivotally coupled legs 17 and 18 and an extension member which is not shown. As with the case of central hub 13, the extension member depending from central hub 16 is opposite legs 17 and 18 and bisects the angle between legs 17 and 18.

The extension members depending from central hubs 13 and 16 are coupled to one another by a variable length support or spreader between base members 11 and 12, the length of spreader bar 19 being dependent only on the number of musical instruments sought to be supported on spreader bar 19. Spreader bar 19 is a replacable element, the length and the form of spreader bar 19 being used being dependent only on the number of instruments which are to be supported.

The top surfaces of legs 14, 15, 17 and 18, central hubs 13 and 16 and spreader bar 19 have disposed therein means 20 for removably securing thereto instrument supports. Means 20 can take the form of any conventional coupling which is consistent with the complementary portions of instrument supports 21, 22 and 23. As an example, supporting means 20 can take the form of a receiving, screwthreaded receptacle where the bottom portion of instrument supports 21, 22 and 23 have a screwthreaded surface adapted to be received within supporting means 20. It would be obvious to one having skill in the art that supporting means 20 could take the form of a tapered receptacle with instrument supports 21, 22 and 23 having mating portions.

Instrument supports 21, 22 and 23 along with extensions thereof provide means for supporting substantially all types of musical instruments. As an example, instrument support 21, when secured within supporting means 20, will hold a saxophone securely in position in a manner which is well understood by those having skill in the art. Instrument support 21 can be altered in size to accommodate saxophones of different configurations such as an alto saxophone or a tenor saxophone. A support illustrating the variation in size is shown in FIG. 1 and is designated by the reference numeral 21'. Instrument support 22 provides flexibility to the present invention 10 by allowing it to be used by different instruments. As shown in FIG. 1, instrument support 22 comprises concentric cylinders 24 and 25 in end abuttment with one another, the axial end of cylinder 25 forming a base 26 for cylinder 24 which is of a greater diameter than cylinder 24. The lower transverse end of cylinder 25 is terminated by base 27 having a larger radius than cylinder 25. In the configuration shown in FIG. 1, instrument support 22 will support a piccolo about cylinder 24 resting on base 26 or a flute about cylinder 25 resting on base 27.

Instrument support 23 constitutes a holding plug adapted to generally engage the bell end of trumpets or other like instruments in an upright position. By varying the size of the cone portion of instrument support 23, it can be adapted to hold various instruments such as a B-flat, C and D trumpet, piccolo trumpet, flugelhorn, and by use of an extention, tenor and bass trombones. This variation in size is shown in FIG. 1 and is designated by the reference numeral 23'. Instrument supports 21, 22 and 23 are preferably provided with screwthreads or a tapered end, supporting means 20 being provided with complementary screwthreads or a receiving tapered receptacle respectively.

It is intended that the present invention 10 will rest upon a floor or other level surface and thereupon provide the sturdy base for the musical instruments. A preferred embodiment of the present invention utilizes pivotal pads 28 on the bottom surface of each of legs 14, 15, 17 and 18. Pivotal pads 28 provide a stable base for the present invention 10 irrespective of whether undulations exist in the flooring or other support for present invention 10.

An object of the present invention is to provide an apparatus for supporting musical instruments which is easily transported and therefore collapsible. An understanding of the manner in which the present invention 10 achieves this objective can best be seen by reference to FIG. 2 wherein a top plan view of a base assembly is shown generally designated by the reference numeral 30 . Base member 30 includes central hub 31 which is substantially triangular in shape. Each apex 32, 33 and 34 of central hub 31 has a respective receiving cavity 35, 36 and 37 as will be described in detail below. As shown in FIG. 2, legs 38 and 39 are pivotally coupled within receiving cavities 36 and 37 respectively. In a like manner, extension member 40 is pivotally coupled within receiving cavity 35 and is adapted to be slidably engaged to a spreader bar which will be discussed in detail below. Supporting means 41 are provided along the top surface of legs 38 and 39 as well as being centrally disposed through central hub 31. As discussed hereinabove, supporting means 41 can take the form of a screw-threaded receptacle or a tapered receptacle, the selection merely being dependent upon the complementary portion of the received instrument supports.

The collapsible nature of the present invention is best seen by reference to FIGS. 3, 4 and 5. In FIGS. 3 and 4, cross-sectional views of the mechanical coupling between the elements are shown. Referring now to FIG. 3, a cross-sectional view of the interface between leg 38 and apex 33 of central hub 31 is shown. Leg 38 is pivotally coupled within receiving cavity 36, leg 38 pivoting about pin 42. Pin 42 extends transversely across apex 33 providing a fulcrum about which leg 38 can pivot. To insure proper locking of leg 38, aperture 43 is formed in central hub 31 in alignment with receiving cavity 36. Helical spring 44 and bearing 45 are disposed within aperture 43, bearing 45 being resiliently urged against detent 46 in leg 38. When leg 38 is opened to its fully extended position as shown in FIG. 3, the resilient force of helical spring 44 and bearing 45 will engage detent 46 locking leg 38 in the extended position. The scope of the present invention encompasses the use of other conventional resilient means in place of helical spring 44 and bearing 45. As can be seen in FIG. 3, in order to provide for full collapsibility of leg 38 within receiving cavity 36, pivoting portion 47 of leg 38 has a substantially constant radius about pin 42. As shown in FIG. 3, when leg 38 is pivoted in a clockwise manner about pin 42, bearing 45 will be released from detent 46 thereby allowing leg 38 to be fully collapsed as will be described in detail below.

Leg 39 is coupled within receiving cavity 37 in the same manner as shown with regard to FIG. 3. Aperture 48 is disposed into apex 34 of central hub 31 in alignment with receiving cavity 37. Leg 39 pivots about pin 49 and is locked in its fully extended position in a manner which is substantially the same as that described with regard to FIG. 3.

An understanding of the manner in which the present invention is assembled is best understood by reference to FIG. 4 wherein a cross-sectional view of the interface between an extention member or extender 40 and central hub 31 is shown. Extender 40 is disposed within receiving cavity 35 and pivoted about pin 55. Pin 55 is disposed transverse to apex 32 through receiving cavity 35. The pivoting portion of extender 40 has a substantially constant radius about pin 55. Aperture 56 is disposed into central hub 31 in alignment with receiving cavity 35. Helical spring 57 and bearing 58 are disposed within aperture 56, bearing 58 being resiliently urged against detent 59 within pivoting portion 60 of extender 40. As with the case of legs 38 and 39, extender 40 can be collapsed by turning same in a clockwise manner causing bearing 58 to be released from detent 59, extender 40 being rotated about pin 55.

To provide for assembly of a pair of base members as shown in FIG. 1, extender 40 is disposed in the position shown in FIG. 4. Tapered portion 61 of extender 40 extends beyond apex 32 and provides means for coupling extender 40 to spreader bar 62. Tapered portion 61 is provided with spring loaded bearing 63 or other similar resilient means for providing cooperative engagement between extender 40 and a receiving portion of spreader bar 62. Spreader bar 62 is provided with supporting means which are substantially the same as those described by reference numeral 41. As discussed previously, supporting means 41 are adapted to receive instrument supports such as those described with regard to FIG. 1. In the embodiment of the present invention shown in FIG. 4, supporting means 41 are shown as being internally screwthreaded and adapted to receive screwthreaded portions of instrument supports such as those designated by reference numerals 21, 22 and 23. As stated, supporting means 41 could utilize other means for providing appropriate couplings such as a tapered projection and receiving receptacle.

FIG. 5 illustrates the manner in which the present invention can be collapsed to provide for easy portability thereby meeting a primary object of the present invention. For the purpose of clarity, the form of the present invention shown in FIG. 5 utilizes the same reference numerals as used with regard to FIGS. 2, 3 and 4. After removal of spreader 62 and any attached instrument supports, legs 38, 39 and extender 40 are pivoted about the appropriate pins 42, 49 and 55 respectively. As shown in FIG. 5, the legs 38 and 39 and extender 40 of each base member are closed upon themselves to provide a compact unit. When these members are in the extended position, the assembly produces a musical instrument supporting apparatus which is substantially stronger than those described in the prior art. In a manner similar to that described previously, leg pads 64 are pivotally coupled to the bottom surfaces of legs 38 and 39 to insure that a sturdy base for the musical instruments is provided irrespective of undulations or defects in the surface upon which the present invention is to be assembled.

Fabrication of the present invention can utilize materials and equipment which are readily available. Referring to FIGS. 2, 3 and 4, central hub 31 is fabricated of sturdy structural material which will be capable of withstanding the operation described hereinabove. As an example, central hub 31 can be constructed as an iron casting or utilize other materials which can be cast in a similar manner. Legs 38 and 39 and spreader bar 62 can be constructed of steel or aluminum stock having a square or circular cross-section, the selection merely being dependent on the configuration chosen for the respective members.

The flexibility of the present invention can be best seen by reference to FIG. 6 wherein additional instrument supports are shown. The instrument supports shown in FIG. 6 illustrate the capability of the present invention to support many types of musical instruments. Instrument support 70 comprises a substantially cylindrical body 71 having a screwthreaded portion 72 at the bottom axial end thereof. Concentric discs 73 and 74 are alternatively secured about cylindrical body 71, the selection thereof being based upon the particular instrument to be supported. By the use of one or the other of discs 73 or 74, instrument support 70 can be used to support a clarinet, oboe or an English horn. The removal or relocation of discs 73 and 74 will also provide support for such instruments as an alto flute, bass flute or a soprano saxophone.

Instrument support 75 is adapted for supporting a bass clarinet or a bassoon. Central member 76 is secured to a screwthreaded support 77, instrument support 75 having appropriately located brackets 78 and 79 for respectively mounting the above-designated instruments. As with the case of instrument supports 21, 22 and 23, the screwthreaded portions 72 and 77 of the support shown in FIG. 6 are adapted to be mounted within the supporting means 20 of the embodiment of the present invention shown in FIG. 1.

In operation, the present invention can be transported in a disassembled condition consisting of a pair of base members and a spreader bar along with the appropriate instrument supports. The present invention can be quickly assembled by merely inserting the respective extenders into the spreader bar and attaching the appropriate instrument supports. It can therefore be seen that the present invention meets all of the objectives by providing a collapsible, easily transportable musical instrument supporting apparatus which is substantially sturdier and more flexible than those described in the prior art.

I claim:

1. A musical instrument supporting apparatus comprising:

a. a pair of base members each having:

i. a central hub;

ii. a pair of legs pivotally coupled to said central hub and adapted to be pivotally rotated about a pivoting end thereof and being in a planar relationship with respect to each other when pivoted to their extended position;

iii. an extender pivotally coupled to said central hub and adapted to be pivoted about a pivoting end thereof and being in a planar relationship with respect to said legs when pivoted to its extended position;

b. a spreader bar adapted to be removably coupled to said extenders, the ends of said spreader bar each being slidably mounted about one of said extenders when said extenders are in the extended position;

c. musical instrument supporting means for securely-supporting musical instruments, said musical instrument supporting means comprising an instrument support having first and second cylindrical members in axial abuttment with one another, said first cylindrical member having a smaller diameter than said second cylindrical member, and a base member in axial abuttment to said second cylindrical member and disposed on the opposite end thereof from said first cylindrical member; and d. supporting means disposed within said central hub, legs and spreader bar, each of said supporting means having portions in cooperative relationship with said mounting members.

* * * * *